United States Patent [19]

Leonard et al.

[11] 3,988,517

[45] Oct. 26, 1976

[54] GAS KNIFE PROCESS FOR CONTROLLING HOT-DIP ALUMINUM COATINGS

[75] Inventors: Ralph W. Leonard, Plum Borough; George R. Taylor, Jefferson Borough, both of Pa.

[73] Assignee: United States Steel Corporation, Pittsburgh, Pa.

[22] Filed: May 19, 1975

[21] Appl. No.: 578,859

[52] U.S. Cl. ..... 427/349; 118/63; 427/431; 427/434 R; 427/436

[51] Int. Cl.[2] ..... B05D 3/04; B05D 3/12

[58] Field of Search.... 427/348, 349, 431, 434–436; 118/63, 68

[56] References Cited

UNITED STATES PATENTS

| | | | |
|---|---|---|---|
| 3,406,656 | 10/1968 | Patterson | 118/63 |
| 3,607,366 | 9/1971 | Kurokawa | 118/63 X |
| 3,681,118 | 8/1972 | Ohama et al. | 118/63 X |

*Primary Examiner*—Thomas J. Herbert, Jr.
*Assistant Examiner*—Bruce H. Hess
*Attorney, Agent, or Firm*—Arthur J. Greif

[57] ABSTRACT

A gas knife process for controlling the thickness profile of hot-dip aluminum coatings, employs a hybrid gas knife design incorporating both a "curved-lip" with a "bow-tie" orifice. This design, in combination with very close knife to strip distance at the strip edges, was found to provide desirable coating profiles. Best results are obtained with knife deflections of 5° to 30° below the horizontal while utilizing orifice pressures of 15 to 70 mm of Hg at line speeds of 20 to 150 m/min.

7 Claims, 2 Drawing Figures

GAS KNIFE PROCESS FOR CONTROLLING HOT-DIP ALUMINUM COATINGS

Figure 1A:
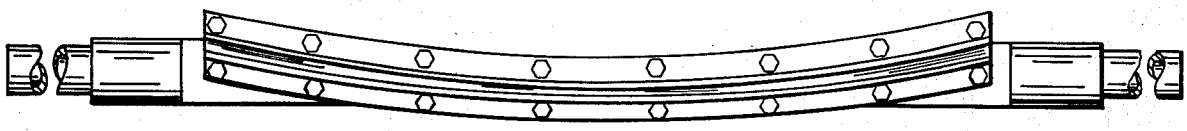

This invention relates to a method for the control of hot dip aluminum coatings and is particularly related to a novel orifice design which when employed with certain other requisite process parameters will provide superior coating profiles.

Gas knives for controlling the coating thickness and coating profile of hot-dip metal coatings have now gained wide commercial acceptance for use in continuous, high-speed lines. With respect to the production of both galvanized and terne-coated products, excellent operating performance and improved coating weight control and product quality have been realized. Gas knife systems have gained such commercial acceptance, since when compared with the more conventional coating roll control systems the industry has realized; (a) higher production line speeds, (b) elimination of down time for coating roll changes, (c) lower rates of consumption of hot metal and (d) superior product quality with less rejects. Although the art has long been aware of the significant advantages afforded by gas knife systems, attempts to utilize such systems for control of hot-dip aluminum coatings have not been as successful, primarily because of the lower density and viscosity of molten aluminum.

During continuous hot dip coating, the strip, as it passes through the molten coating-bath metal, exerts a drag effect on the molten metal and pulls a given amount along as it emerges from the bath. The amount of metal dragged from the bath is approximately proportional to the square roots of line speed, metal density, and viscosity. In galvanizing and terne-coating operations, considerable excess coating metal is usually dragged along by the strip. Therefore, the function of gas knives for coating-weight control is to meter metal flow by means of various controlled parameters so that a uniform, thin, prescribed thickness of coating metal remains on the strip. The excess coating metal cascades down the strip toward the bath, and under normal conditions, a dynamic equilibrium is established. In contrast, when processing aluminum-coated-sheet product at line speeds comparable to those used for galvanizing, much less molten aluminum is dragged from the bath. Both the density (2.7 g/cm$^3$ for aluminum vs 7.14 g/cm$^3$ for zinc) and viscosity (1.3 cp at 677° C for aluminum vs 3.5 cp at 454° C for zinc) are significantly lower for aluminum than for zinc. Thus, there is less metal to be wiped during aluminum-coating operations, and relatively low pressures are needed for gas-knife coating-weight control. Low knife pressures characteristically cause problems associated with poor edge wiping (buildup of excess coating metal at the strip edges). This behavior at low pressures occurs also in galvanizing operations, but low pressures are needed only for heavy-gage product that is produced at slow line speeds.

It is therefore a principle object of this invention to provide a continuous hot-dip aluminum coating process for achieving desired coating control through the use of gas-knives.

Figure 1B:
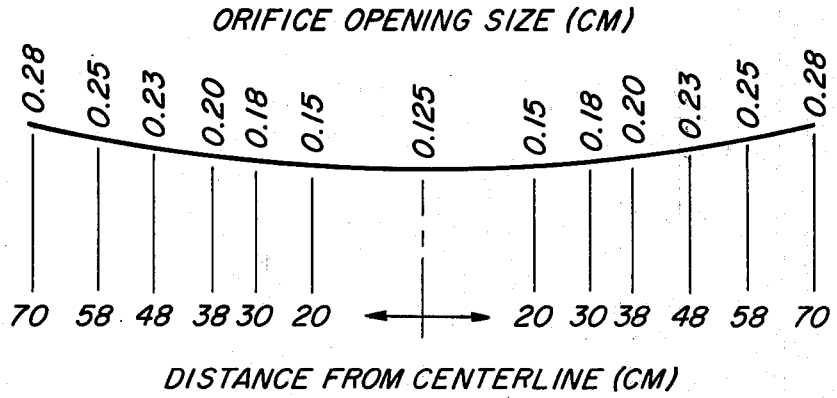

These and other objects and advantages of the instant invention will be more apparent from a reading of the following description, when taken in conjunction with the appended claims and drawings in which:

FIG. 1*a* is a schematic representation of a hybrid orifice air-knife design, and FIG. 1*b* is illustrative of a preferred variation in orifice opening, for an orifice having a slot length of 140 cm.

With respect to hot-dip aluminum coatings, initial attempts to employ gas knife systems, analogous to those employed in galvanizing operations, included gas knives with straight lips (eg. U.S. Pat. No. 3,459,587). These straight lip orifices were deemed unacceptable primarily because suitable wiping of the strip edges was not accomplished, resulting in excessive spooling during recoiling and poor shape during temper rolling. In an attempt to overcome this problem, both the curved lip design of U.S. Pat. No. 3,406,656 and a bow-tie design (see Butler et al, *Iron and Steel Engineer*, February, 1970) were also evaluated. Although both of these latter designs offered some improvement over that of the straight lip design, neither was capable of providing an optimum coating weight profile or desirably reproducible results. It was, however, found that desirable results could be obtained at line speeds of 20 to 150 m/min. by utilizing a hybrid gas knife which incorporated the features of the curved lip orifice and the bow-tie orifice designs; in combination with knife pressures of at least 7mm Hg and knife-to-strip distances, at the strip edges of from 0.3 to 2.0 cm.

FIG. 1*a* is a schematic representation illustrating the primary features of a gas knife useful in the instant invention showing both the upwardly concave curvature of the orifice and the variation of the orifice opening, exhibiting a maximum value at both ends of the slot length and decreasing in a generally uniform manner to a minimum value at the center. The reasons for separately employing either such a curvature or such a bow-tie opening are more fully explained in U.S. Pat. No. 3,406,656 and the Butler et al article noted above, the disclosures of which are both incorporated herein by reference. It should be noted, while the opening varies in a generally uniform manner, that it is not necessary that the lips denote a continuous curve. Thus for example, (as shown in Butler et al — FIG. 14), the opening could exhibit a minimum at the center and then increase somewhat linearly to a maximum at the edges.

In addition to the shape and design parameters of the gas knife, it was found that operation within certain specific ranges of (i) angle of knife deflection, (ii) knife-to-strip distance, (iii) knife pressure, (iv) line speed, (v) height of knife above the bath and (vi) bath temperature, were desirable for the achievement of quality product and/or reproducible results.

Knife Design Parameters — The optimum radius of curvature of the orifice is, of course, dependent on the width of the strip being coated. In general, for strip having a width of about 0.25 to 1.5 meters, the effective radius of curvature will vary from about 4 to 16 meters, the effective radius increasing in approximate proportion with said strip width. Minimum opening values at the center of the slot length may, in general, vary from about 0.1 to 0.2 cm; while maximum opening values at the edges will preferably vary from about 0.2 to 0.4 cm. Obviously, openings within the lower end of the maximum value range will be employed coincidentally with openings in the lower end of the minimum value range. A particularly preferred variation of orifice opening, for a gas knife system using air for the establishment of a gas barrier, is shown in FIG. 1*b*.

Knife Deflection — The upwardly concave curved orifice of this invention is specifically designed for processes utilizing downwardly directed gas barriers, i.e. downwardly deflected knives. Deflections of from about 5° to 35° may be employed. However, when employing deflections within the lower end of the range, i.e. about 5° to 15°, it will generally be more difficult to obtain high coating weights, (i.e. average coating weights in excess of about 125 g/m$^2$) in combination with low line speeds. It is therefore preferable to employ downward deflections within a range of about 15° to 25° as an optimum deflection for all but the very slowest line speeds.

Knife-to-Strip Distance — Control of this distance was found to be important for two different reasons. Both the amount of oxide entrained with the coating at the strip edges and the amount of coating buildup at the edges are both decreased as knife-to-strip distance is decreased. In addition to the superior edge wiping resulting from close knife to strip distances, it was also observed that as this distance increased, especially beyond about 2.0 cm, that unexplainable variations in coating weight were encountered from test to test, even when identical processing conditions were used. It should be noted that the accurate determination of this distance is complicated by the lip curvature, which, when the knives are downwardly deflected, results in a continually variable knife-to-strip distance (i.e., minimum distance at the edge and a maximum distance at the center of the knives). Therefore it was found that this all important measurement could better be monitored, by measuring the minimum distance between the lips of the opposing knives at the extreme ends of the knives and thereafter using this knife-to-knife distance to calculate the knife-to-strip distance at the strip edges. While very small knife-to-strip distances will, in general, provide a superior coating profile. In actual practice, knife-to-strip distances below about 0.3 cm. will generally be impractical, since it then becomes difficult to maintain such close tolerances on the strip pass line so as to prevent intermittent rubbing against the knife. A preferable range is therefore from 0.45 to 0.9 cm.

Knife Pressure — Knife pressures below about 7mm of Hg were generally erratic in their ability to achieve adequate edge wiping. To insure consistently good edge wiping, it is further preferable to employ pressures of about 15 to 100 mm of Hg. Obviously, lower pressures within this range will be employed for making thicker coatings, whereas higher pressures within the range will be used for making lighter weight coatings.

Line Speed — The general effect of line speed in hot dip aluminum coating is quite analogous to that noted in galvanized coating. At speeds within the higher end of the range, i.e. greater than about 50 m/min., sufficient metal is dragged from the bath to establish good flow back of excess Al to the bath, thereby permitting the use of sufficiently high knife pressures to readily obtain clean strip edges. At lower speeds, much less molten metal is dragged from the bath, thereby requiring more critical adjustment of the other process parameters.

Knife Height Above the Coating Bath — Lower heights (eg. 10 to 20 cm) do, in general, provide somewhat enhanced edge wiping. However, such low heights may create some additional problems; a. the danger of splashing of hot metal onto the knife assembly, and b. tendency towards orifice distortion as a result of higher knife assembly temperatures. Thus, while such lower heights may successfully be employed, heights of about 20 to 40 cm will generally be more practical.

Bath Temperature — Temperatures within the range of about 637° to 677° C are desirable. Within this range, temperatures at the higher end, tend to enhance edge wiping as well as result in slightly increased coating weight.

In addition to the above noted parameters, the desirability of maintaining the strip relatively equidistant from the opposing knives is, of course, well known. Otherwise, excessive buildup can result if the strip is closer to one knife than the other. Methods for achieving proper pass line control are well known to the art; for example, through the use of rub bars to both flatten the strip and stabilize the pass line. In addition to requiring that the strip be relatively equidistant from each knife, the instant hybrid knife design, in particular, requires that the strip's center line be approximately coincident with the center of the knives (position of minimum orifice opening) so as to achieve an optimum coating profile. It was found however that strip movements of up to about 8cm. in either direction from center could readily be tolerated.

As a result of operating within the parameters outlined above, it was found in addition to the previously noted advantages of reduced consumption of aluminum and increased production rates, that further benefits were derived from improved temper rolling performance including (a.) a material decrease in the amount of rerolling required to obtain desired sheet flatness, (b.) a decrease in the amount of temper-mill rejections and (c.) a significant increase in the temper rolling speeds for much of the product.

We claim:

1. In the hot-dip aluminizing of ferrous metal strip, a method for controlling the thickness profile of the aluminum coating, which comprises;
   a. passing the strip, at a line speed of 20 to 150 m/min., through a bath containing molten aluminum,
   b. directing the strip with its molten aluminum coating adhering thereto, through a generally curvilinear, upwardly concave orifice gas knife having a slot opening, the length of which is greater than the width of the strip being coated, said opening exhibiting a maximum value at both ends of the slot length and decreasing in a generally uniform manner to a minimum value at the center of said slot length, said knife being situated a distance of 20 to 40 cm above the top surface of said bath,
   c. establishing a gas barrier to said molten coating by maintaining (i) a knife pressure of at least 7 mm Hg and (ii) a knife to strip distance, at the strip edges, of from 0.3 to 2 cm, said gas barrier having a downward deflection of from 5° to 35°.

2. The method of claim 1, wherein said bath temperature is 637° to 677° C.

3. The method of claim 2, wherein said knife pressure is 15 to 70 mm Hg, and said downward deflection is within the range 15° to 25°.

4. The method of claim 3, wherein said knife to strip distance is 0.45 to 0.9 cm.

5. The method of claim 4, wherein said strip has a width of about 0.25 to 1.5 meters and said curvilinear orifice has an effective radius of curvature of from 4 to 16 meters, in which the effective radius is approximately proportional to said strip width.

6. The method of claim 5, wherein said minimum value opening at the center of said slot length is 0.1 to 0.2 cm and said maximum value opening is within the range of 0.2 to 0.4 cm., and wherein openings within the lower end of the maximum value range are employed when said minimum value openings are in the lower end of the minimum value range.

7. The method of claim 6, wherein air is the gas employed for establishing said barrier.

* * * * *